US010348027B2

(12) United States Patent
Zhao

(10) Patent No.: US 10,348,027 B2
(45) Date of Patent: Jul. 9, 2019

(54) CONNECTOR

(71) Applicant: Tyco Electronics (Shanghai) Co. Ltd., Shanghai (CN)

(72) Inventor: Yuqiang Zhao, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/278,453

(22) Filed: Sep. 28, 2016

(65) Prior Publication Data

US 2017/0093075 A1 Mar. 30, 2017

(30) Foreign Application Priority Data

Sep. 29, 2015 (CN) ..... 2015 1 0629691

(51) Int. Cl.

| | |
|---|---|
| ***H01R 13/502*** | (2006.01) |
| ***H01R 24/60*** | (2011.01) |
| ***H01R 12/72*** | (2011.01) |
| *H01R 13/514* | (2006.01) |
| *H01R 43/20* | (2006.01) |
| *H01R 107/00* | (2006.01) |
| *H01R 13/506* | (2006.01) |
| *H01R 13/74* | (2006.01) |

(52) U.S. Cl.

CPC ..... *H01R 13/502* (2013.01); *H01R 12/724* (2013.01); *H01R 24/60* (2013.01); *H01R 13/506* (2013.01); *H01R 13/514* (2013.01); *H01R 13/74* (2013.01); *H01R 43/20* (2013.01); *H01R 2107/00* (2013.01)

(58) Field of Classification Search

CPC ..... H01R 13/514; H01R 13/14; H01R 12/724
USPC ..... 439/79, 634, 541.5
See application file for complete search history.

(56) References Cited

U.S. PATENT DOCUMENTS

| | | | | |
|---|---|---|---|---|
| 3,646,500 | A * | 2/1972 | Wessely | H01R 13/113 439/381 |
| 3,951,492 | A * | 4/1976 | Braund | H01R 31/00 439/494 |
| 4,140,361 | A * | 2/1979 | Sochor | H01R 13/113 439/682 |
| 6,503,093 | B1 * | 1/2003 | Sakata | H01R 12/7005 439/160 |
| 7,713,093 | B2 * | 5/2010 | Kim | H01R 13/6278 439/660 |
| 8,747,165 | B2 * | 6/2014 | Kim | H01R 24/60 439/607.53 |
| 9,225,132 | B2 * | 12/2015 | Kim | H01R 24/60 |
| 2009/0247011 | A1 * | 10/2009 | Myer | H01R 13/4223 439/595 |
| 2012/0045935 | A1 * | 2/2012 | Zhang | H01R 12/724 439/607.08 |

* cited by examiner

*Primary Examiner* — Tho D Ta
*Assistant Examiner* — Marcus E Harcum
(74) *Attorney, Agent, or Firm* — Barley Snyder

(57) ABSTRACT

A connector is disclosed. The connector comprises a housing having a receiving passageway, an insert having a slot in a surface of the insert, and a contact. The contact is disposed in the slot, and the insert is disposed in the receiving passageway.

15 Claims, 5 Drawing Sheets

CONNECTOR

CROSS-REFERENCE TO RELATED APPLICATIONS

This application claims the benefit of the filing date under 35 U.S.C. § 119(a)-(d) of Chinese Patent Application No. 201510629691.6, filed on Sep. 29, 2015.

FIELD OF THE INVENTION

The present invention relates to a connector, and more particularly, to an electrical connector for connecting two electrical apparatuses.

BACKGROUND

Known electrical connectors connect two electric components to transmit or provide electric power between the components or to provide a communication connection between the components. Many known connectors include a contact terminal and an insulation material that encloses or surrounds the contact terminal for protection.

In order to dispose the contact terminal in the insulation material, the following two methods are typically used in the prior art: directly molding the insulation material around the contact terminal, or molding an insulation carrier with the insulation material and then inserting the contact terminal into a slot or opening in the insulation carrier. Since a manufacturing process of molding an insulation material around a contact terminal is relatively complicated and specially designed moulds are required, production cost is relatively high. Therefore, the second prior art method above is most commonly used, in which an insulation carrier is molded first and then a metal component having a contact terminal is inserted into a channel in the insulation carrier.

In order to provide a suitable fixation between the contact terminal and the insulation carrier while also allowing for proper engagement between the contact terminal and another contact terminal, the contact terminal usually has a curved rather than straight shape. The curved shape of the terminal, however, leads to increased difficulties in manufacturing the insulation carrier and assembling the contact terminal and the insulation carrier. Consequently, production cost is increased and assembling efficiency is lowered.

SUMMARY

An object of the invention, among others, is to provide a connector having an insulation carrier and a contact terminal which can be efficiently assembled. The disclosed connector comprises a housing having a receiving passageway, an insert having a slot in a surface of the insert, and a contact. The contact is disposed in the slot, and the insert is disposed in the receiving passageway.

BRIEF DESCRIPTION OF THE DRAWINGS

The invention will now be described by way of example with reference to the accompanying figures, of which:

FIG. 8(*b*) is a perspective view of a contact of the plurality of contacts of FIG. 7;

FIG. 8(*c*) is a perspective view of a contact of the plurality of contacts of FIG. 7; and FIG. 8(*d*) is a perspective view of a contact of the plurality of contacts of FIG. 7.

DETAILED DESCRIPTION OF THE EMBODIMENT(S)

Figure 1:
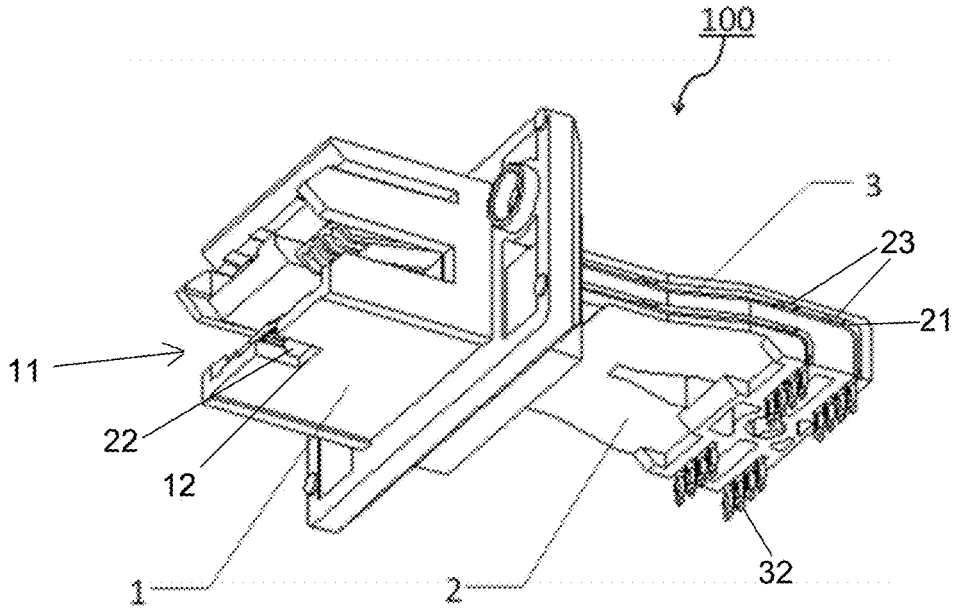
FIG. 1 is a perspective view of a connector according to the invention.

The invention is explained in greater detail below with reference to embodiments of a connector. This invention may, however, be embodied in many different forms and should not be construed as limited to the embodiments set forth herein; rather, these embodiments are provided so that this disclosure will be thorough and complete and still fully convey the scope of the invention to those skilled in the art.

It is to be noted that, orientational terms such as "up", "down", "left", "right", "lateral", "top", "bottom" and the like as used in the description are based on orientations shown in the drawings. However, these orientations may vary depending on practical situations of use of a product. Thus, these terms should not be construed as limitations to the scope of the invention.

Figure 2:
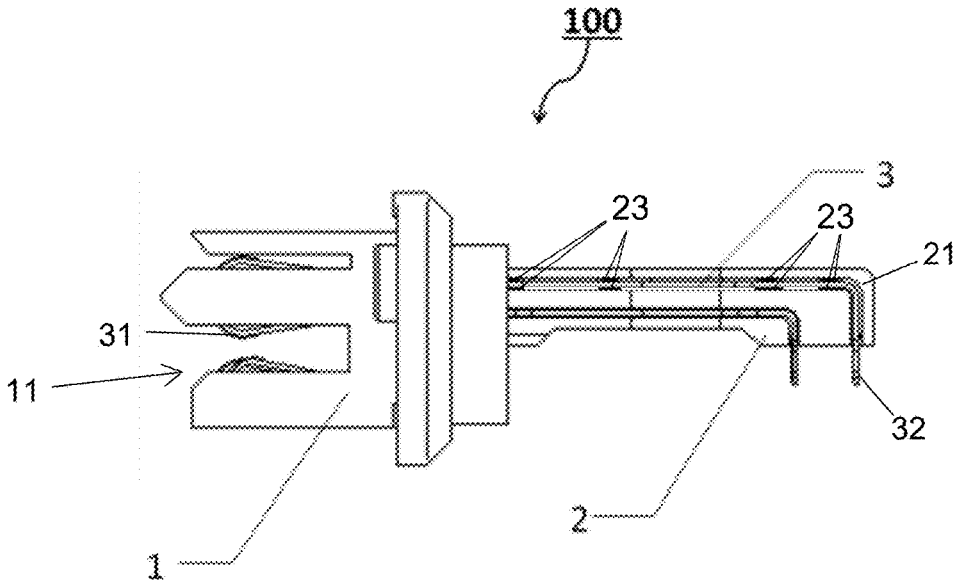
FIG. 2 is side view of the connector of FIG. 1.
Figure 3:
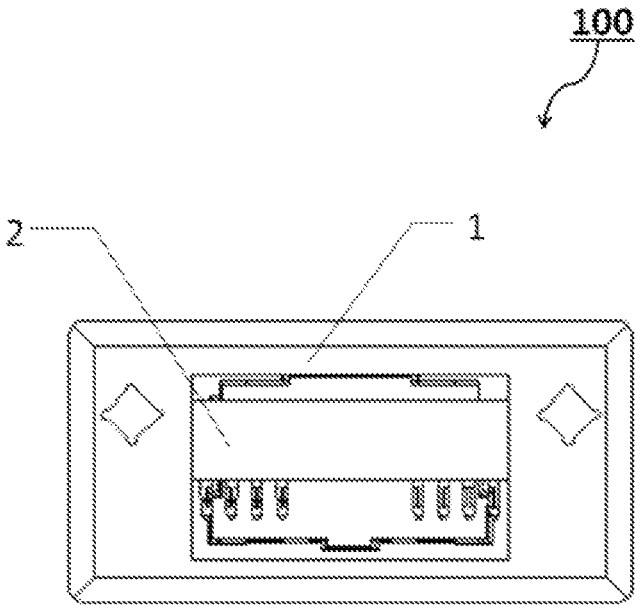
FIG. 3 is a rear view of the connector of FIG. 1.

A connector 100 according to the invention is shown generally in FIGS. 1-3. The connector 100 comprises a housing 1, an insert 2, and at least one contact 3. The major components of the invention will now be described in greater detail.

Figure 4:
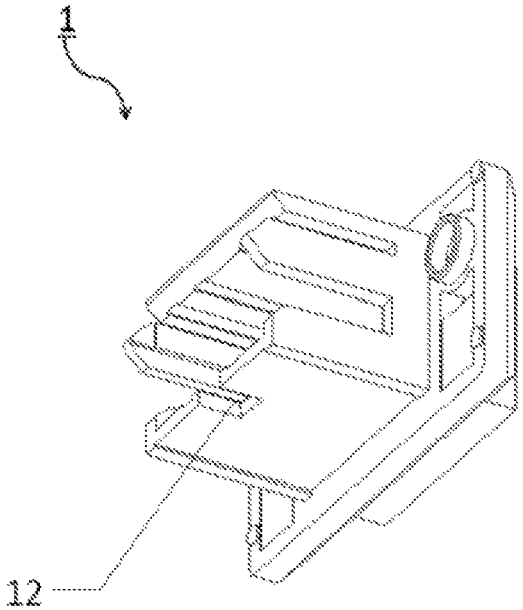
FIG. 4 is a perspective view of a housing of the connector of FIG. 1.
Figure 5:
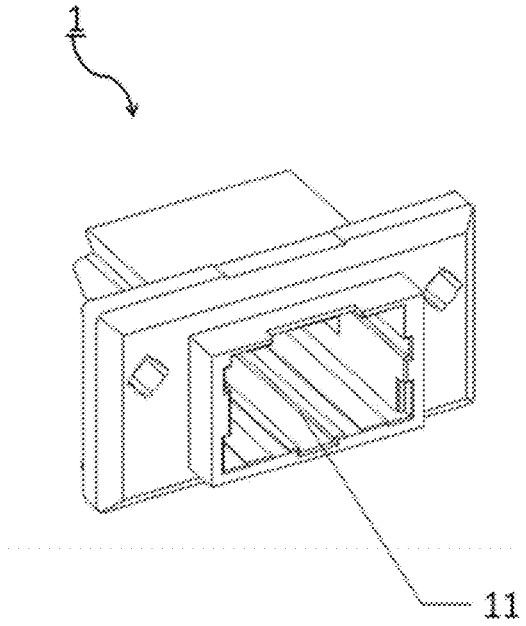
FIG. 5 is a perspective view of the housing of FIG. 4.

The housing 1 is shown in FIGS. 4 and 5. The housing 1 is formed of an insulative material and has a receiving passageway 11 and a notch 12. The receiving passageway 11 extends through the housing 1, and in the embodiment shown in FIG. 5, is approximately rectangular shaped. The receiving passageway 11 may alternatively be a square shape, an elliptical shape, or other shapes known to those with ordinary skill in the art. The notch 12, as shown in FIG. 4, is disposed on a bottom side of the housing 1. The housing 1 may be formed by molding.

Figure 6:
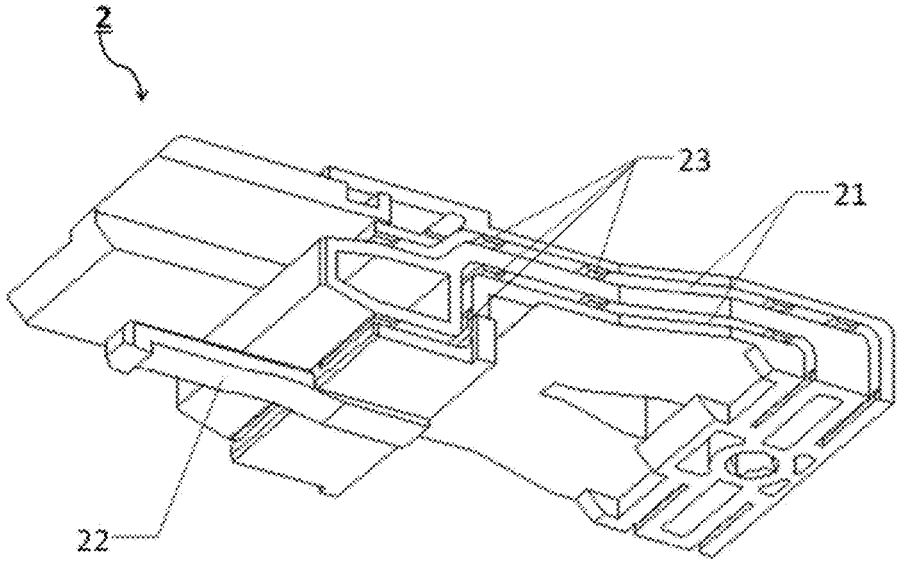
FIG. 6 is a perspective view of an insert of the connector of FIG. 1.

The insert 2 is shown in FIG. 6. The insert 2 is formed of an insulative material and has at least one slot 21, an arm 22, and a plurality of protrusions 23. The insert 2 may be formed by molding.

The at least one slot 21 is disposed in a side surface of the insert 2. Other side surfaces of the insert 2 may also be provided with at least one slot 21, and the number of slots 21 may be determined according to practical applications. In the embodiment shown in FIG. 6, the insert 2 has two slots 21 extending into each of two opposite side surfaces of the insert 2. In other embodiments, upper and/or bottom surfaces of the insert 2 may also be provided with at least one slot 21.

The arm 22, as shown in FIG. 6, is connected to and extends away from a bottom side of the insert 2. The arm 22 is a resilient member.

The plurality of protrusions 23 are disposed on an inner side wall of the at least one slot 21. The plurality of protrusions 23 extend into the at least one slot 21 such that the at least one slot 21 is narrowed at predetermined positions corresponding to the plurality of protrusions 23. In the embodiment shown in FIGS. 2 and 6, the plurality of protrusions 23 are provided at two opposite inner side walls of the slot 21 and are aligned in pairs.

Figure 7:
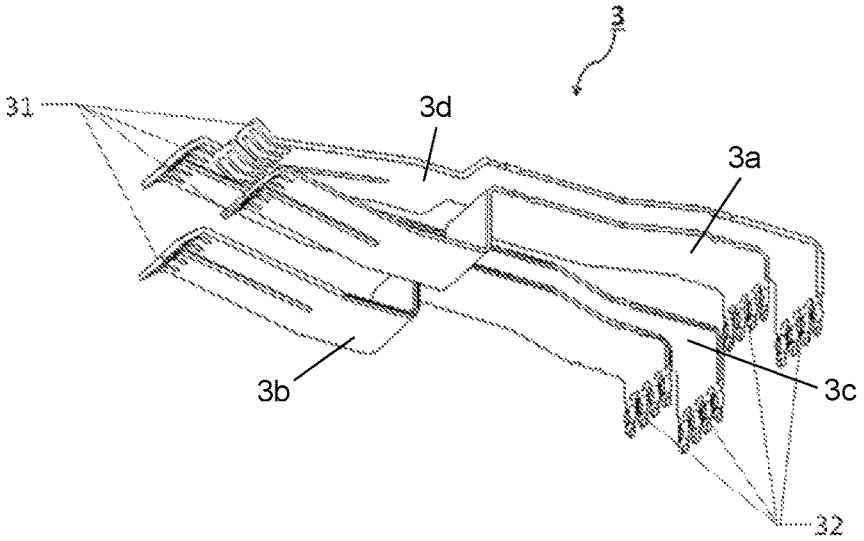
FIG. 7 is a perspective view of a plurality of contacts of the connector of FIG. 1.
Figure 8A:
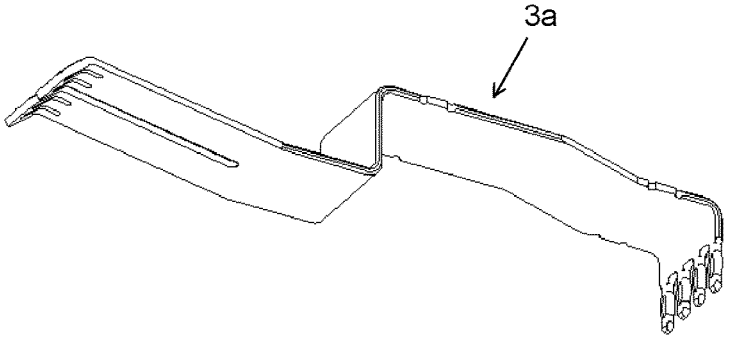
FIG. 8(*a*) is a perspective view of a contact of the plurality of contacts of FIG. 7.
Figure 8B:
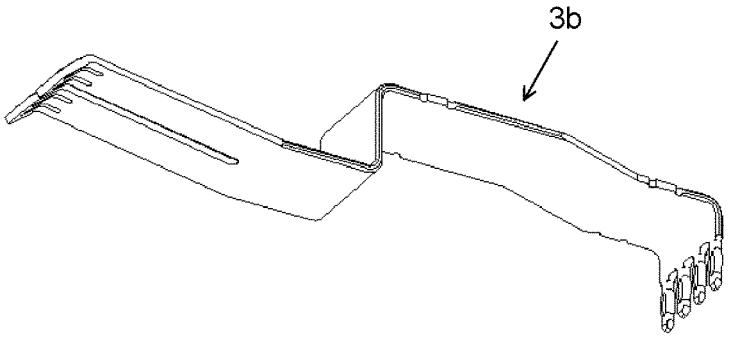
Figure 8C:
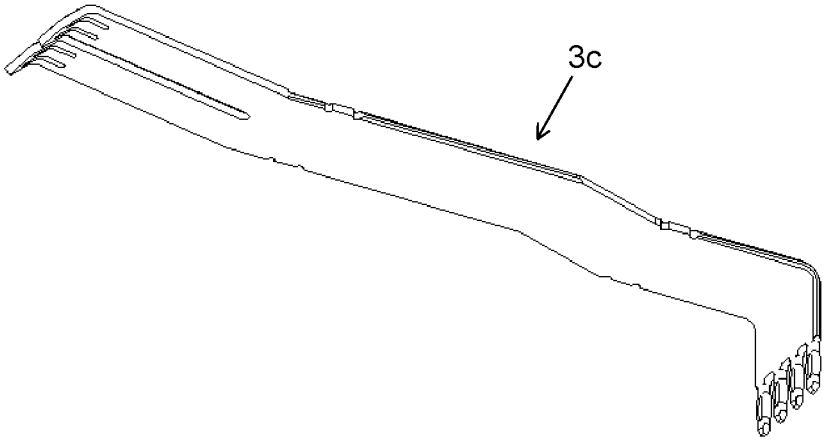
Figure 8D:
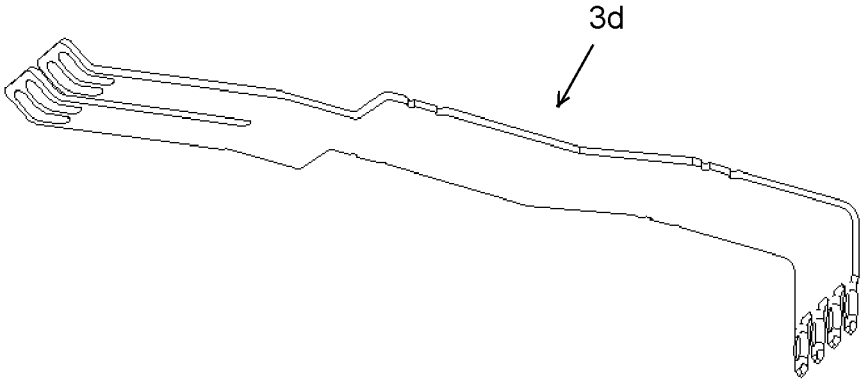

The at least one contact 3 is shown in FIGS. 7 and 8(*a*)-8(*d*). The at least one contact 3, as shown in FIG. 7, has a first terminal 31 at a first end and a second terminal 32 at an opposite second end. The at least one contact 3 is formed of a metal material and, in the shown embodiment, is plate-shaped such that the first terminal 31 and the second terminal 32 may be formed or machined at each end of the contact 3. In other embodiments, the contact 3 may have a different shape, such as a circular cross section. The shape of the contact 3 is associated with its specific application, and should not be construed as a limitation to the scope of the invention.

As shown in FIGS. 7 and 8(*a*)-8(*d*), the at least one contact 3 may include four contacts 3*a*, 3*b*, 3*c*, and 3*d* each having a first terminal 31 at a first end and a second terminal 32 at an opposite second end. As shown in FIGS. 7 and 8(*a*)-8(*d*), each of the contacts 3*a*, 3*b*, 3*c*, and 3*d* has a contact bend at a central portion and/or at a rear portion. The contacts 3*a*, 3*b*, 3*c*, and 3*d* may be differently shaped or have the same shape; in the shown embodiment, contacts 3*a* and 3*b* are substantially the same shape, and contacts 3*c* and 3*d* are each shaped differently from the other contacts 3.

The assembly of the connector 100 will now be described in greater detail with reference to FIGS. 1-3.

The insert 2 is mounted into the receiving passageway 11 of the housing 1. Although the housing 1 and the insert 2 shown in FIGS. 1-6 have specific structures, one with ordinary skill in the art would appreciate that they may have other different structures, provided the insert 2 can be inserted into and secured within the housing 1. An outer profile of the housing 1 is associated with its application, and the profile shown in FIGS. 1-6 should not be construed as a limitation to the scope of the invention. A front end of the insert 2 to be inserted into the housing 1 may also have a specific shape, which is associated with a specific structure of a component to which it is to be connected such as a shape matching an interior shape of the receiving passageway 11, and shall not be construed as a limitation to the scope of the invention.

As shown in FIG. 1, the arm 22 engages the notch 12 after the insert 2 is inserted into the housing 1, detachably securing the insert 2 within the housing 1 and preventing the insert 2 from disengaging from the housing 1. As would be understood by one with ordinary skill in the art, the housing 1 and the insert 2 may be secured together by other or different securing mechanisms or in a different way. For example, in another embodiment, the housing 1 and the insert 2 may be secured together through a screw.

The at least one contact 3 is mounted in the at least one slot 21. The plurality of protrusions 23 secure the at least one contact 3 within the at least one slot 21. A contact surface between the contact 3 and the slot 21 becomes a point contact between the contact 3 and the slot 21 at the plurality of protrusions 23, and consequently, an insertion resistance of the contact 3 into the slot 21 is decreased. Moreover, in order to further facilitate the insertion of the contact 3, a corner of the contact 3 at an inserting side thereof and/or an opening end of the slot 21 may be chamfered. A width of the slot 21 may be less than a thickness of the contact 3 to provide a clamping force on the contact 3. In another embodiment, due to the protrusions 23, the width of the slot 21 may be formed wider and may be equal to or even larger than the thickness of the contact 3, with the clamping force provided by the protrusions 23.

The first terminal 31 and the second terminal 32 extend out from respective ends of the at least one slot 21. The first terminal 31 extending out from the front end of the slot 21 may be further exposed through the receiving passageway 11 so as to permit connection to a contact terminal of another electric device (not shown). As shown in FIGS. 1-3, the at least one contact 3 has a contact bend corresponding to and in a same location as a slot bend of the at least one slot 21. In an embodiment, the contacts 3*a*, 3*b*, 3*c*, and 3*d* may be mounted within four different slots 21 provided in two opposite side surfaces of the insert 2.

Thus, in a method of forming the connector 100, the non-rectilinear contact 3 may be easily assembled with the housing 1 by dividing an insulation component into the housing 1 and the insert 2, providing the slot 21 in the side surface of the insert 2, mounting, by laterally inserting, the contact 3 into the slot 21, and mounting the insert 2 in the housing 1.

Advantageously, in the connector 100 according to the present invention, the insert 2 reduces difficulties in disposing the contact 3 within the housing 1, leading to decreased cost and a higher production rate. Furthermore, due to the protrusions 23 provided on the side walls of the slot 21, the width of the slot 21 may be formed wider and may be equal to or even larger than the thickness of the contact 3. Consequently, difficulties in molding a sufficiently narrow slot 21 to provide a clamping force on the contact 3 are avoided, further improving assembling efficiency. Additionally, the connector 100 enables the slot 21 to be widened and an outer profile of the insert 2 to remain the same, so the insert 2 may be manufactured with less material, and production cost can thereby be further reduced.

What is claimed is:

1. A connector, comprising:

a housing having a receiving passageway;

an insert having a slot in a surface of the insert, a plurality of protrusions disposed on each of two inner side walls of the slot and extending into the slot, each protrusion on one of the two inner side walls is aligned with another protrusion on the other one of the two inner side walls in a first direction perpendicular to a longitudinal direction of the slot, a width between each set of aligned protrusions in the first direction is less than a width between the inner side walls in the first direction; and a contact disposed in the slot, the width between the inner side walls in the first direction is larger than a thickness of the contact in the first direction and each of the protrusions abuts the same contact such that the contact is spaced apart from both of the inner side walls in the first direction, the insert disposed in the receiving passageway.

2. The connector of claim 1, wherein the housing is formed of an insulative material.

3. The connector of claim 2, wherein the insert is formed of an insulative material.

4. The connector of claim 1, wherein the receiving passageway extends through the housing.

5. The connector of claim 1, wherein the housing has a notch.

6. The connector of claim 5, wherein the insert has an arm extending away from the insert.

7. The connector of claim 6, wherein the arm engages the notch to detachably secure the insert within the housing.

8. The connector of claim 1, wherein the contact has a first terminal at a first end.

9. The connector of claim 8, wherein the contact has a second terminal at an opposite second end.

10. The connector of claim 9, wherein the first terminal and the second terminal extend out from opposite ends of the slot.

11. The connector of claim 1, wherein the contact has a contact bend corresponding to a slot bend in the slot.

12. The connector of claim 1, wherein the contact is plate-shaped.

13. A method of assembling a connector, comprising:

providing a slot in a side surface of an insert with a plurality of protrusions disposed on each of two inner side walls of the slot and extending into the slot, each protrusion on one of the two inner side walls is aligned with another protrusion on the other one of the two inner side walls in a first direction perpendicular to a longitudinal direction of the slot, a width between each set of aligned protrusions in the first direction is less than a width between the inner side walls in the first direction;

laterally inserting a contact into the slot, the width of the slot between the inner side walls in the first direction is larger than a thickness of the contact in the first direction and each of the protrusions abuts the same contact such that the contact is spaced apart from both of the inner side walls in the first direction; and mounting the insert into a housing.

14. The connector of claim 1, wherein the plurality of protrusions are spaced apart along the longitudinal direction of the slot.

15. The method of claim 13, wherein the first direction is perpendicular to an insertion direction in which the contact is laterally inserted into the slot.

* * * * *